United States Patent [19]

Bearce

[11] 4,191,530

[45] Mar. 4, 1980

[54] DRYER

[76] Inventor: Wendell E. Bearce, Box 241, St. Clairsville, Ohio 43950

[21] Appl. No.: 944,573

[22] Filed: Sep. 21, 1978

[51] Int. Cl.[2] ..... F27B 7/08

[52] U.S. Cl. ..... 432/107; 432/112; 432/113

[58] Field of Search ..... 432/107, 112, 113, 114, 432/118

[56] References Cited

U.S. PATENT DOCUMENTS

| | | | |
|---|---|---|---|
| 2,500,553 | 3/1950 | Lykken | 432/112 |
| 3,013,785 | 12/1961 | King | 432/107 X |
| 3,401,923 | 9/1968 | Bearce | 432/37 |
| 4,014,106 | 3/1977 | Bearce | 432/107 |

*Primary Examiner*—John J. Camby
*Attorney, Agent, or Firm*—William J. Ruano

[57] ABSTRACT

A dryer for removing moisture from wet fine particles, such as coal, comprising an insulated stationary cylinder in which an open-ended metallic cylindrical tube is rotated, coaxially in an essentially horizontal position. Wet particles are introduced in said open end while hot air is circulated between the stationary cylinder and the tube.

Substantial improvement in the overall efficiency is obtained by recirculating some of the spent products of combustion into the rotary drying cylinder as well as in a preheater or heat exchanger to heat the air used for combustion.

2 Claims, 6 Drawing Figures

DRYER

This invention is an improvement over that covered in my prior U.S. Pat. Nos. 3,401,923, dated Sept. 17, 1968, and 4,014,106 dated Mar. 29, 1977 for a DRYER.

While the dryer described in my aforesaid earlier patents is highly efficient, it has the drawback of embodying somewhat numerous parts, which add significantly to the cost of manufacture, as well as to the cost of maintenance of the dryer, also it is far less efficient from the standpoint of fuel consumption.

An object of my present invention is to provide a novel dryer which has relatively few, simple and inexpensive parts, as compared to those of my prior dryers, and yet which is considerably higher in efficiency in drying wet coal particles and the like.

Another object of my invention is to provide a dryer for wet coal or other particles, which dryer will avoid any danger of forming dust, which under certain circumstances may cause an explosion, as well as being injurious to health of workmen.

Another object of my invention is to suspend chains longitudinally in the rotating cylinder, having the dual function of transferring heat from the heated cylinder to the interior material being dried, as well as scrubbing the interior surface of the drum free of adhering material as well as the steel balls or other loose objects that may be included in the material.

Other objects and advantages will become more apparent from the study of the following description taken with the accompanying drawings wherein.

Figure 1:
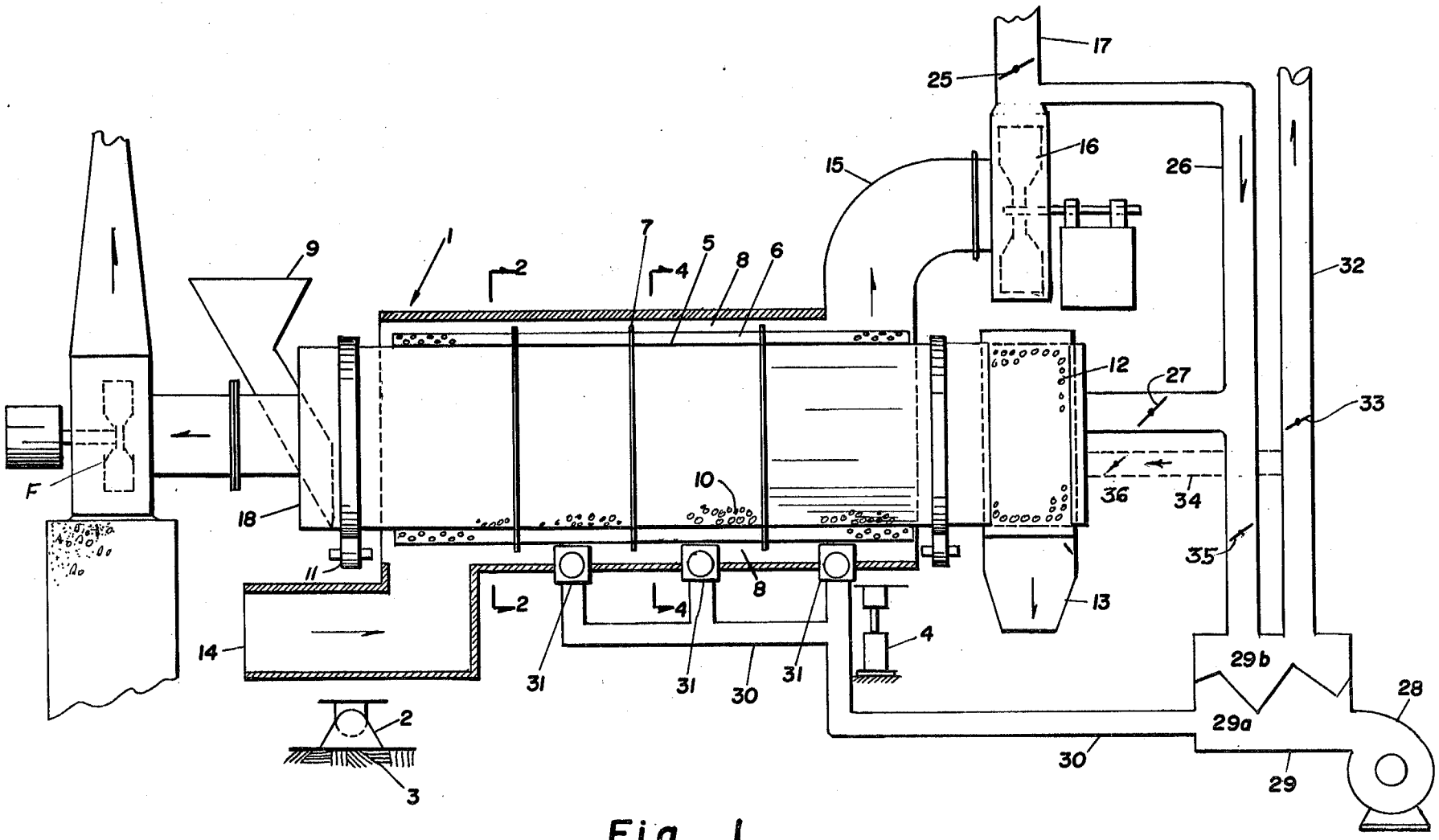
FIG. 1 is a longitudinal, vertical, cross-sectional view of a dryer embodying the principles of the present invention and which is particularly useful for drying wet coal.
Figure 4:
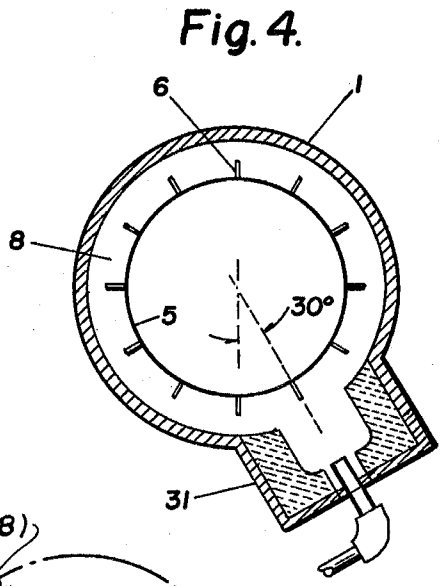
FIG. 4 is a cross-sectional view taken along line 4—4 of FIG. 1.
Figure 3:
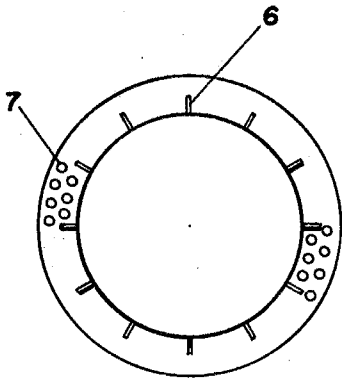
FIG. 3 is an end view showing the annular baffle 7 of FIG. 1.
Figure 2:
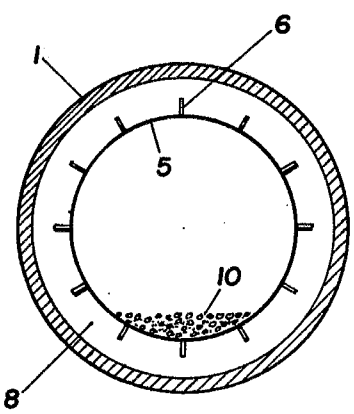
FIG. 2 is a transverse, cross-sectional view taken along line 2—2 of FIG. 1.

Referring more particularly to FIGS. 1, 2 and 3 of the drawing, numeral 1 denotes an insulated, stationary shell of substantially cylindrical construction, which may be pivotally mounted, at one lower end, to a pivot 2 mounted on a floor 3 or other stationary support. At the other end, a jack 4 is mounted which is adapted to selectively lift or lower the shell 1 about its pivot 2 as a center if it is to be adjusted to other than the normal horizontal position of shell 1. The jack may be omitted and a fixed slope used.

Interiorly and coaxially of the shell 1 is a rotatably mounted, hollow metal cylinder or tube 5. A plurality of perforated heat transferring fins 6 are integrally welded or otherwise rigidly secured to the outer surface of tube 5, as shown more clearly in FIG. 2, and extend throughout the entire length of tube 5. At longitudinally spaced points of tube 5, there are provided perforated annular baffles 7, shown more clearly in FIG. 3. The purpose of fins 6 and baffles 7 is to effectively transfer heat, by conduction, from the outer side of tube 5 to the inner side thereof, to heat the wet particle mixture fed therein. A gap 8 is provided between the outer periphery of each baffle 7 and the interior surface of shell 1. The baffles and fins need not be perforated.

The wet mixture or coal particles is fed into a hopper 9, thence through a large central opening of an end ring 18 and into the interior of cylinder 5. The wet mixture is in the form of a gradually tapering layer which includes a plurality of small metal balls, or possibly other heat transferring particles of other shapes, preferably but not necessarily of metal. However, aluminum oxide is a suitable material for such particles, because of its high heat carrying capacity. The purpose of such metallic balls or other shaped particles is to transfer the heat from cylinder 5 to the wet coal particles and prevent a build-up of wet sticky particles on the inner surface of the tube.

The tube 5 is rotated about its axis by a driving means, including a gear or sprocket 11, powered by a suitable motor or the like (not shown).

At the right of tube 5, as viewed in FIG. 1, there is provided a cylindrical screen section 12 for screening coal particles, after they have been dried, thus separating them from the metallic balls, after which they are discharged through the outlet chute 13. However, the screen 12 and balls may be omitted.

Hot air 14 generated from any suitable heating source is introduced into the space between tube 5 and shell 1 and thereafter discharged through elbow 15 and exhausted, by a fan 16, through an exhaust pipe 17.

In operation, as the wet coal is fed through hopper 9 into tube 5 and mixed with the balls 10 or other heated particles, and as the tube 5 is rotated about its axis, a layer or wet coal particles and such balls will remain at the bottom of the tube and will gradually taper off, in depth, from the left to the right of tube 5, as viewed in FIG. 1, as a consequence of the continual feed by hopper 9. By the time the mix moves into the screen section 12, it will be dry, therefore, it can be suitably screened from the balls or other heated particles.

In order to prevent excessive dust, this can be done by lowering jack 4 to lower the right end of tube 5, therefore speeding up the flow through the dryer and thus decreasing retention time. Conversely, if the coal is too wet, jack 4 may be lifted to slow down the rate of movement longitudinally through tube 5 so as to heat the material to a greater extent. A more effective way to prevent the creation of dust as a result of the drying process is to introduce, in hopper 9, with the wet mix of coal particles, a suitable only material, such as petroleum or other coal derivative which is not volatile at 212° F., the boiling point of water, so as to provide an oily coating to the dried coal particles after the water has been evaporated. As the result of the thorough mixing provided by the tumbling and rolling action of the heated particles and chains and coal in the tube 5, a very thorough drying and coating of oil-like material is provided. A relatively small quantity of such oil-like material is sufficient to make the coal particles free of dust.

The fan F or the stack alone may be used at the feed end to assist movement and in sucking steam out and movement of air leftwardly, keeping a negative pressure in the chamber. A scrubber may be added between the dryer and the fan F to remove any dust particles which may be entrained in the leftwardly moving steam and/or air prior to discharge to the atmosphere. The fan F acts to remove steam and/or air.

A very substantial increase in the efficiency of the dryer is obtained by recirculating some or a very substantial amount of the products of cumbustion, otherwise lost through the chimney, by turning off damper 25 so as to circulate the products of combustion through pipe 26 and open damper 27 into the rotating inner barrel or shell.

Still another improvement in the overall efficiency of the dryer is obtained by circulating forced air by means of combustion air blower 28 which flows air into the lower chamber 29*a* of a combustion air preheater or heat exchange unit and through manifold 30 which feeds the air into a plurality of gas or oil burners 31 which heat the rotary tube 5. Some of the products of combustion in pipe 26 may be fed into the upper chamber 29*b* of the preheater or heat exchanger 29, thence through an outlet pipe 32 which may be connected to a chimney which may be the same as that to which pipe 17 leads. Thus the air is heated and used for combustion and the dampers 25 and 27 may be regulated to direct all or any portion of the products of combustion to either tube 5 or preheater 29, or both, at will. If desired the air exiting the upper chamber 29*b* of preheater 29 may be directed into tube 5 through pipe 34 by opening damper 36 and closing damper 33. The above described heating system aids in the dryer by effectively utilizing the heat in the spent products of combustion otherwise being discharged to the atmosphere.

Figure 6:
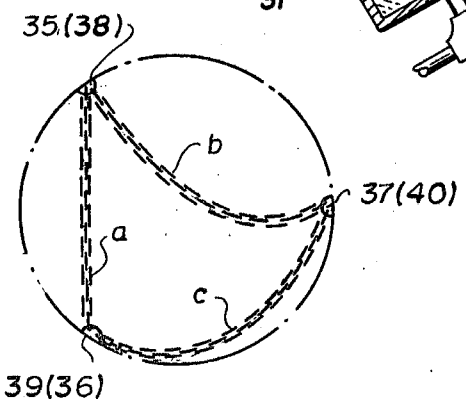
Figure 5:
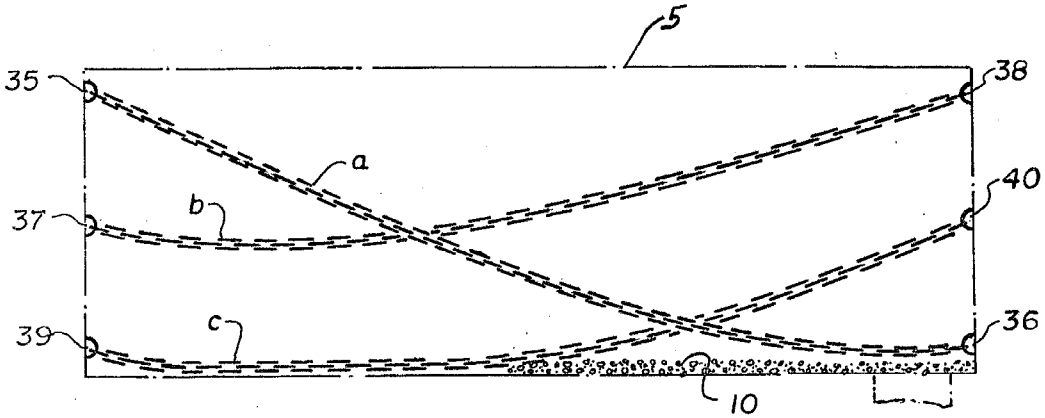
FIG. 5 is a longitudinal, vertical, cross-sectional view of a modification of the inner rotating, heated cylinder embodying suspended chains; and, FIG. 6 is an end view as seen from the left side of FIG. 5.

FIGS. 5 and 6 show a modification of my invention for more effectively preventing adherence of material to the inner surface of the heated cylinder 5, more rapidly transferring heat from the exterior to the interior of the cylinder as well as to promote more thorough mixing of the material being dried, provide more dependable control of lumps and agglomerations and eliminate the necessity for a screen section. A plurality of chains, such as a, b, and c, are suspended between opposite ends of the cylinder 5, such as chain a between points 35 and 36, chain b between points 37 and 38 and chain c between points 39 and 40.

It will be noted in FIG. 5 that the lowermost suspended chain c is sufficiently loose so as to scrape the interior surface of cylinder 5 to more effectively transfer heat by virtue of metallic contact of chain c with the inner walls of the cylinder and by removal therefrom of the wet mixture 10.

In operation, as cylinder 5 is rotated so that chains b and a are successively loosely suspended in the same manner as chain c, that is, when positioned lowermost in cylinder 5, they will in turn effect transfer of heat from outside to inside the heated cylinder and to the material being dried. However, chains a, b and c have the further function of scrubbing the interior walls of the drum free of adhering wet material and the steel balls or other loose objects 10 which may be included in the mixture. In some instances, the steel balls 10 may be omitted and reliance made entirely on the chains for both transferring heat from the interior of the cylinder 5, scrubbing the interior wall continuously of adhering material, thoroughly mixing the material being dried and eliminating lumps and agglomerations. The ends of the chains may be suspended either parallel to the longitudinal axis of tube 5 or in a position other than parallel so as to provide an advancing or retarding effect on the particles being dried, as desired.

While the dryer has been described as being useful for drying coal particles, it may be used for drying other types of particles, as well as coating them with an oil-like film to prevent excess formation of dust or with suitable additives in preparation for pelletizing or briquetting.

Thus it will be seen that I have provided a highly efficient, yet extremely inexpensive dryer made up of relatively few parts and requiring very little maintenance, providing a high degree of heat transfer from the heated air source to the interior of the rotating tube without the necessity of a central tube and screw conveyer, screen, scoops and flap gates, as required in my prior patent, which is very difficult to make completely air tight; furthermore, I have provided a dryer construction having no contact between the coal or other particles being dried and the hot gases for heating and drying it and wherein no power is required for lifting the steel balls, and no noise results from their dropping as in my prior patent, and whereby the necessity for sealing between the hot gases for drying and the cylinder handling the material being dried is eliminated.

While I have illustrated and described several embodiments of my invention, it will be understood that these are by way of illustration only and that various changes and modifications may be contemplated in my invention and within the scope of the following claims.

I claim:

1. A dryer for drying wet particles, comprising a substantially horizontal drum mounted for rotary driving movement about its axis, a hopper for introducing said wet particles into one end opening of said drum, a stationary housing spaced from and surrounding said drum, burners in said housing for heating said drum, an exhaust opening at the opposite end of said housing for exhausting products of combustion of said housing, means including a fan for sucking air and moisture from said one end of said drum for maintaining a negative pressure in said drum, means for recirculating exhaust air from said opposite end of said housing so as to recirculate spent products of combustion and increase the efficiency of said dryer, said recirculating means including a heat exchange unit having one compartment powered by a blower for blowing draft air into said burners and another compartment of the heat exchange unit connected to said recirculating means and to a chimney, and a damper means for enabling selective flow of said spent products of combustion from said other end of said housing to either said last mentioned compartment of said heat exchange unit or to said chimney.

2. A dryer as recited in claim 1 together with duct means including a damper for selective introduction of air in said last mentioned compartment to said opposite end of said drum to recirculate spent products of combustion.

* * * * *